United States Patent [19]

Lee

[11] Patent Number: 4,466,489

[45] Date of Patent: Aug. 21, 1984

[54] SELF-CONTAINED FIRE PROTECTION APPARATUS

[75] Inventor: John T. M. Lee, Phoenixville, Pa.

[73] Assignee: ICI Americas Inc., Wilmington, Del.

[21] Appl. No.: 354,223

[22] Filed: Mar. 3, 1982

[51] Int. Cl.[3] ..... A62C 13/40

[52] U.S. Cl. ..... 169/26; 169/57; 169/85; 222/136; 222/399; 239/373

[58] Field of Search ..... 169/19, 26, 57, 75, 169/76, 85; 239/373; 222/136, 394, 399

[56] References Cited

U.S. PATENT DOCUMENTS

| | | |
|---|---|---|
| 2,525,802 | 10/1950 | Joerren . |
| 2,976,897 | 3/1961 | Beckworth . |
| 3,245,582 | 4/1966 | Roth et al. . |
| 3,523,583 | 8/1970 | Poitras et al. . |
| 3,613,954 | 10/1971 | Bayne . |
| 3,713,458 | 1/1973 | Lee . |
| 3,815,793 | 6/1974 | Morane et al. . |
| 4,318,443 | 3/1982 | Cummins . |

OTHER PUBLICATIONS

"Fire Protection Handbook", 12th Edition, 1962, George H. Tryon, ed., National Fire Protection Association, Boston, Mass., publisher, pp. 16-220-16-225.

*Primary Examiner*—Andres Kashnikow

*Attorney, Agent, or Firm*—Louis F. Kreek, Jr.

[57] ABSTRACT

Self-contained fire protection apparatus. The present apparatus comprises a first container for storing water or other liquid under atmospheric pressure, a discharge conduit from this container, and a second container having high surface to volume ratio for storing liquefied propellant under pressure. Communication between the first and second containers is prevented until the apparatus has to be used. Then the propellant transfer line connecting the two containers is opened, preferably by actuation of a valve controlling this line, allowing propellant vapors to flow into the first container and establish a pressure therein sufficient to cause discharge of the contents of the first container. Heat exchange between the water being discharged and the propellant is provided so that the propellant temperature and pressure do not drop appreciably as the propellant is being evaporated and transferred.

2 Claims, 9 Drawing Figures

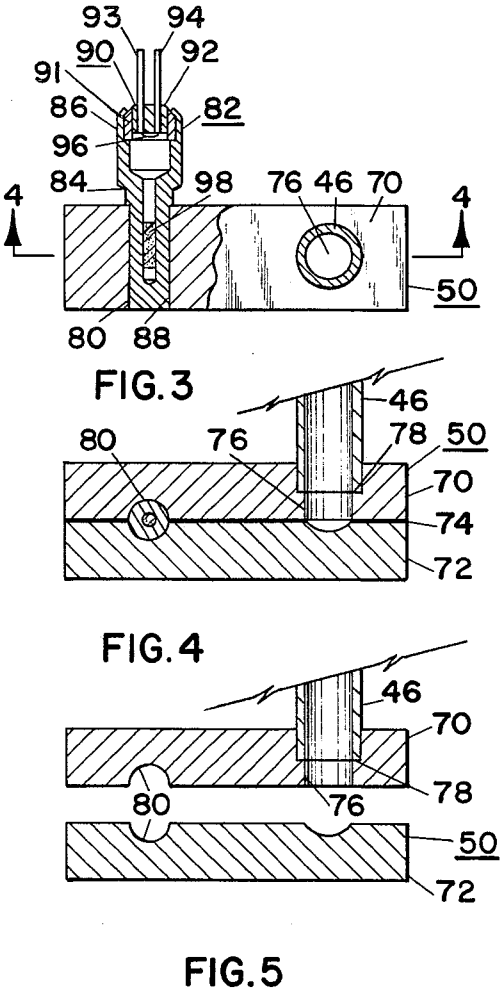
FIG. 3
FIG. 4
FIG. 5
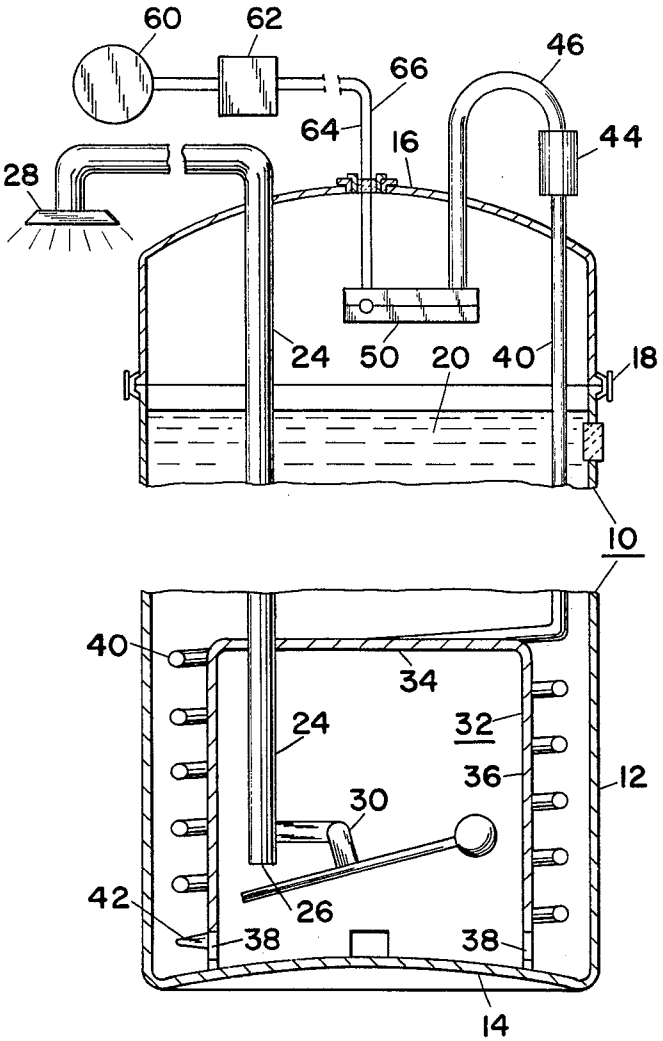
FIG. 2
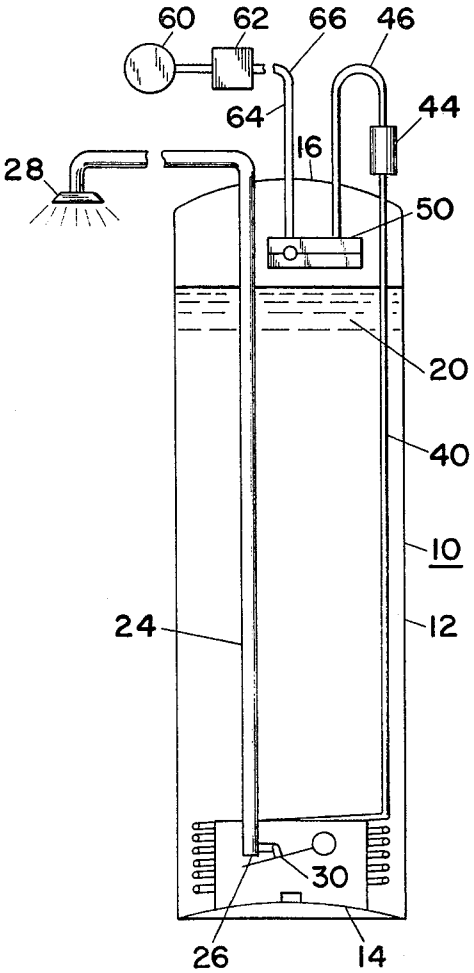
FIG. 1

SELF-CONTAINED FIRE PROTECTION APPARATUS

BACKGROUND OF THE INVENTION

1. Field of the Invention

This invention relates to self-contained systems for dispensing a liquid such as water. More particularly, this invention relates to self-contained fire extinguishing systems.

2. Description of the Prior Art

Self-contained automatic sprinkler systems are known in the art. Such systems are supplied by a water tank, and are suitable for protecting a limited area from fire. The more familiar automatic sprinkler systems, in contrast, are generally supplied from a water main and typically protect a whole building or a section or wing thereof. Self-contained systems are much more easily installed than conventional systems in existing buildings.

Various self-contained automatic sprinkler systems are described in "Fire Protection Handbook", 12th Edition, 1962, George H. Tryon, ed., National Fire Protection Association, Boston, Mass., publisher, pages 16–220 to 16–225. Particular attention is directed to page 16–224, where an apparatus, comprising a water tank which is not continuously pressurized, cylinders containing compressed gas (nitrogen) for pressurizing the water tank on command, and a manifold system which includes a pressure reducing and regulating valve, is described. Disadvantages of such a system are that it requires storage of a compressed gas under high pressure (on the order of 2,000 psig), that the pressure reducing valve may not operate properly after long standing and that the compressed gas cylinders may gradually lose pressure due to leakage through the reducing valve or an actuating valve. Since the apparatus is an emergency action device, it may stand in "ready" or unactuated state for years before being called on to perform. Periodic inspection is highly desirable to make sure that the system is in good working order.

Use of a volatile liquid under pressure is known in the beverage dispensing and in the aerosol dispenser arts, although not (as far as applicant is aware) in the art of sprinkler systems for fire protection. The references discussed below illustrate systems in which a volatile liquid under pressure supplies the pressure necessary for dispensing a liquid.

U.S. Pat. No. 3,613,954 to Bayne describes a carbonated beverage dispenser which includes a first container in which a carbonated beverage (e.g., beer) is stored under pressure and at sub-atmospheric temperature, a spigot which controls the dispensing of the beverage, and a second container for a volatile liquid (or liquefied gas), such as a fluorocarbon, in liquid form under pressure. As the beverage is dispensed, a portion of the volatile liquid in vapor form flows from the second container to the head space of the first container to maintain pressure in the first container. In the embodiments of FIGS. 1–6, the composition of the liquefied gas is such that its vapor pressure at 45° F. (7° C., which is the preferred beer storage temperature) will be about 15–20 psig (approximately 2–2.3 atmospheres absolute), which is the desired headspace pressure in the first container. Also, in the preferred embodiment, the container for liquefied gas is outside the first container so that the heat of vaporization will be supplied from the surroundings rather than from the contents of the first container. FIGS. 7 and 8 illustrate embodiments in which a more volatile liquefied gas, i.e., one having a vapor pressure considerably higher than 15–20 psig at 45° F., is used. The container for liquefied gas in these embodiments is below the normal liquid level inside the first container.

U.S. Pat. No. 2,976,897 to Beckworth describes a reusable pressurized canister containing a liquid to be dispensed and pressurized by a pressure reservoir.

U.S. Pat. No. 3,815,793 to Morane et al. describes an aerosol container which is pressurized by a volatile liquid (or a liquefied gas) stored under pressure in a cartridge which is inside the principal container. The contents of the aerosol container are pressurized at all times.

U.S. Pat. No. 3,523,583 to Poitras et al. shows a fire extinguishing apparatus comprising a cylinder filled with a fire extinguishing fluid and having an expandable end wall at one end, a frangible end wall at the other end, and a detonator for rupturing the frangible end wall when it is desired to dispense the fluid.

To date there is no liquid dispensing system which is both reliable and ready to operate after standing idle for years, and at the same time is capable of delivering the pressurizing fluid at the high rate required to dispense the entire quantity of liquid contained for that purpose at a predetermined operating pressure. The systems described in the Fire Protection Manual require seals (such as valve seats and sealing rings) of non-metallic resilient material which will permit slow escape of gas, and which therefore require periodic checking to assure that the gas cylinders have sufficient pressure and that the system is ready to operate. The operating pressure would be considerably lower than the propellant storage pressure in the systems described in the Bayne, Morane et al. and Beckworth patents cited above, because the rate of heat transfer from the liquid to be dispensed to the propellant would be too slow to maintain the temperature and pressure of the propellant as it evaporates. There is needed a liquid dispensing system which has assured reliability after long standing, and which will reliably cause pressurization of the container of liquid to be dispensed, without substantial decrease of pressure during dispensing.

SUMMARY OF THE INVENTION

The apparatus of the present invention comprises a first container which is normally under atmospheric pressure for containing a first liquid to be dispensed, said container having an outlet for discharging said liquid when said container is pressurized; a second container, having a high surface to volume ratio so as to provide a substantial wall surface area for heat transfer, for containing a volatile propellant in liquid form under pressure; means providing for heat transfer via indirect heat exchange from a flowing stream of said first liquid to the propellant during dispensing; a normally closed passageway connecting the interior spaces of said first and second container; and means operable from outside the first container for opening the passageway to permit propellant vapors to flow from the second container to the first container, thereby pressurizing said first container and causing said first liquid to be dispensed.

An important feature of the present apparatus is that the container for propellant (the second container) has both a high ratio of surface area to volume and a substantial wall surface area in heat exchange relationship with the first liquid. These provide rapid and efficient heat transfer from the first liquid to the propellant as the first liquid is being dispensed. In this manner most of the heat required for vaporization of the propellant is obtained from the first liquid and not from the remaining propellant liquid, so that little drop in propellant temperature or pressure takes place.

The apparatus of this invention is particularly useful as a fire extinguishing apparatus.

BRIEF DESCRIPTION OF THE DRAWINGS

FIG. 1 is a front sectional view of the apparatus according to a preferred embodiment of this invention.

FIG. 2 is a front sectional view of the preferred embodiment of this invention, with a portion broken away and the remaining portion shown in greater detail than in FIG. 1.

FIG. 3 is a top elevational view, shown partly in section, of the preferred quick release valve for use in the preferred embodiment of this invention.

FIG. 4 is a cross-sectional view, taken along line 4—4 of FIG. 3, of the quick release valve before actuation.

FIG. 5 is a cross-sectional view of the quick release valve of FIGS. 3 and 4 after actuation.

DESCRIPTION OF THE PREFERRED EMBODIMENTS

Figure 9:
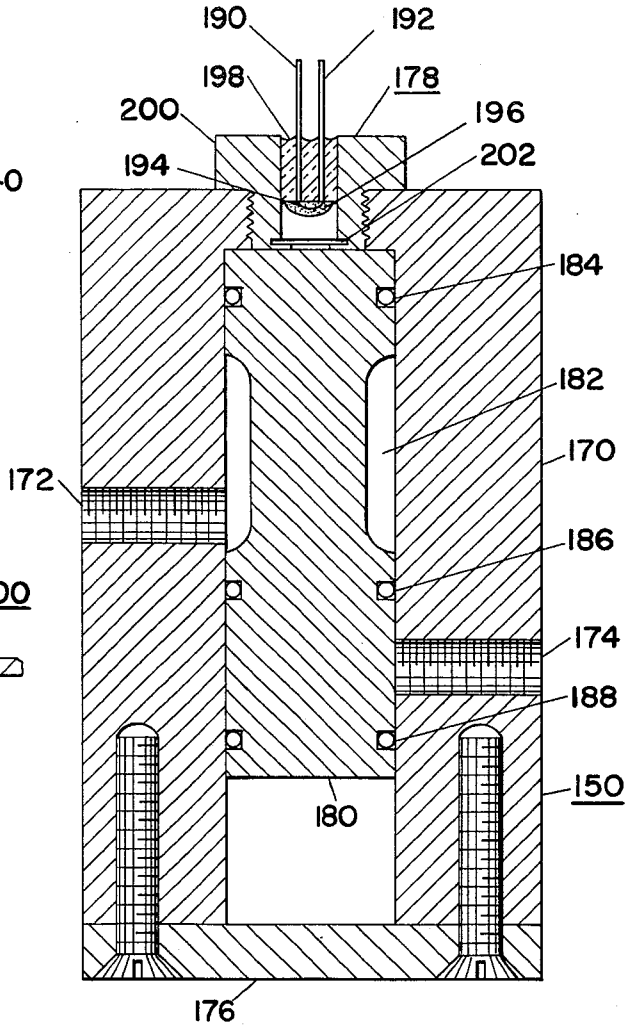
FIG. 9 is a longitudinal sectional view of a spool valve which is used in the second embodiment of this invention.

This invention will now be described with reference to two specific embodiments. Both illustrate the use of apparatus of this invention as a fire extinguisher, which is the preferred use. However, the apparatus has other uses as will be explained in further detail later.

The apparatus of both embodiments includes a tank (the first container) containing water under ambient conditions and having a discharge conduit extending from the tank to a location which is to be protected against fire. Each embodiment includes a tubular container (the second container) which contains a volatile propellant in liquid form under pressure, and a normally closed passageway which extends from the second container to the interior space of the first container. A normally closed valve which is openable on command from outside the water tank is used in each case to keep this passageway closed. When the passageway from the second container to the first container is opened, propellant is vaporized and flows from the second container to the headspace of the first container, causing the first container or tank to be pressurized and thereby causing water to be dispensed. Vaporization of the propellant requires considerable heat input in order to prevent the propellant pressure and temperature from dropping as liquid is dispensed. The two embodiments of this invention described in detail illustrate different ways of providing the necessary heat transfer from the water to the propellant in order to maintain the desired propellant pressure and temperature.

Description of the First Embodiment

Referring now to FIGS. 1 and 2, a fluid tight container 10 (the first container), shown here as a vertical cylindrical container, has a cylindrical side wall 12, a bottom wall 14, and a top 16. Container 10 is preferably made in two parts to permit easy access to the interior. The two parts are joined together along fluid tight joint 18, which extends around the circumference of side wall 12 near the top thereof.

Container 10 contains a body of liquid 20 to be dispensed. Water is the preferred liquid for most fire extinguishing purposes, which constitutes the preferred use of the apparatus of this invention. The normal liquid level (or water line) inside container 10 is a short distance below the joint 18. This leaves an air space, or headspace, at the top of container 10. The water or other liquid 20 inside container 10 is normally under ambient conditions, i.e., the headspace is at atmospheric pressure and the water temperature is that of the surrounding area. When the container 10 is inside a heated building, ambient temperature will typically be about 20°-25° C. (about 68°-77° F.), although it can be higher or lower.

A discharge conduit 24 extends from the interior of container 10, below the liquid level thereof and normally near the bottom thereof, to a location outside container 10 to which liquid is to be delivered. Discharge conduit 24 has an opening 26 at the bottom thereof for receiving liquid 20 from container 10. Opening 26 is thus the outlet for container 10. Discharge conduit 24 terminates in a sprinkler head 28 which is located at the area to be protected against fire. Such location may be, for example, the bed of an elderly or infirm person, and the immediate area surrounding the bed. A float valve 30, which is normally open, closes opening 26 in the event that the liquid level in container 10 drops to a level near that of opening 26. This prevents propellant vapors, which are present in the headspace of container 10 during and after functioning, from being vented to the atmosphere.

Sprinkler head 28 is normally at a higher elevation than the normal liquid level of liquid 20 in container 10. Where the sprinkler head 28 is at a lower elevation than the normal liquid level, it is desirable to provide an opening to the atmosphere at some point higher than the normal liquid level in order to prevent siphoning.

A portion of discharge conduit 24 is above the normal liquid level in container 10. This prevents discharge of liquid from container 10 except when the headspace of container 10 is pressurized. When the apparatus is standing, air at atmospheric pressure fills both the headspace of the container 10 and the portion of conduit 24 above the liquid level in container 10.

The discharge conduit 24 may have a manually controlled normally open valve (not shown) to permit closure thereof. Such valve if provided should be used only as means for shutting down the apparatus. It is intended that operation of the apparatus of this invention will always be initiated by opening the normally closed passageway leading from the propellant container to the water storage tank, as will be hereinafter described, and not by control through a valve in the discharge conduit 24.

A baffle 32, having a flat circular top 34 and a cylindrical side wall 36 with openings 38 at the bottom thereof, rests on the bottom 14 of container 10. This causes fluid being discharged from the apparatus to be directed through the annular space between container side wall 12 and baffle side wall 36, thence through openings 38 and then into opening 26 of discharge conduit 24.

The propellant container 40 (the second container) is in the shape of a tube which is closed by a fusion seal at its lower end 42, and which has a helical (or coiled) lower portion and a straight vertical upper portion that extends through the top wall 16. This helical configuration, taken together with the high surface to volume ratio inherent in a tube, provides a large container wall area below the water line to permit heat transfer from the body of water 20 to the propellant when water is being discharged from the container 10. The container 40 may have a double helical portion instead of the single helical portion shown if desired. Above container 40 there is a sight glass 44 which permits visual observation of the liquid level of the propellant. If the liquid level in the sight glass is proper there is no question that sufficient propellant exists. There is no need to rely on pressure gauges that can fail or to weigh the extinguisher. A transfer tube 46 extends from sight glass 44 through container top 16 into the headspace of container 10. Sight glass 44 is hermetically sealed to tubes 40 and 46.

The transfer tube 46 is filled with propellant vapors. As long as transfer tube 46 is closed, propellant liquid and vapor are at equilibrium at the vapor pressure of the propellant material. The vapor pressure is a function of the volatility of the propellant material and the temperature, as is well known.

The preferred propellant is dichlorodifluoromethane, $CCl_2F_2$. Chlorodifluoromethane, $CHClF_2$, is also a good propellant. In general, the lower molecular weight fluorocarbons are suitable propellants. Other propellants can be used. The propellant should have an atmospheric boiling point below 20° C. (which is approximately the normal ambient temperature of a unit located inside a heated building). As a practical matter, the propellant should have a superatmospheric vapor pressure, preferably at least about 50 psig (about 4.3 atmospheres absolute) at ambient temperature. Some superatmospheric pressure is required just to lift the water to the highest elevation in discharge conduit 24. Some additional pressure is required for efficient operation. The discharge rate tends to be too slow when a propellant having a vapor pressure below about 50 psig is used. Propellant materials having much higher vapor pressures can be used. The upper limit of vapor pressure is limited only by safety considerations and by the strength of the apparatus (especially vessel 10). For example, liquid carbon dioxide can be used, but it requires an apparatus capable of withstanding operating pressures up to about 1000 psig. Materials having lower vapor pressures are ordinarily preferred. Preferred vapor pressures are from about 50 psig to about 100 psig. Excellent results are obtained at about 75 psig. The operating pressure (i.e., the pressure in the headspace of container 10) during discharge is very nearly equal to the vapor pressure of the propellant, as will be explained later.

Quick release valve 50, which is at the discharge end of tube 46, maintains transfer tube 46 in the normally closed state. Valve 50 in transfer tube 46 remains closed as long as the apparatus is in its normal, "ready", or "standing" state. In this state, propellant inside container 40 is maintained under pressure and at ambient temperature, while the headspace in container 12 is normally at both ambient temperature and pressure (i.e., atmospheric pressure). Opening of valve 50 allows propellant in container 40 to vaporize and to flow into the headspace of container 10.

A preferred quick release valve 50 will be described later in further detail with reference to FIGS. 3, 4 and 5.

A valve actuation system, located primarily outside vessel 10, is provided for operating valve 50 on command. This system may be powered either by a battery, or by ordinary house current (e.g., 110 volts), or by a combination of the two (i.e., by house current with a standby battery). (The power supply is not shown). The valve actuation system includes a detector 60, which is placed in the protected area. For example, it may be placed in or near the ceiling above a patient's bed. Detector (or sensor) 60 is capable of sensing some abnormal condition. It may be a smoke detector, a flame detector, a high temperature sensor, or a detector which senses the rate of temperature rise. The detector generates an output signal when it senses an abnormal condition. Suitable detectors and sensors are well known in the art. The system may also include an alarm 62 which gives a visible or audible indication when detector 60 senses an abnormal condition. Wires 64, 66 communicate an output signal from detector 60 via leads (hereinafter to be described) inside container 10 to actuate valve 50 when detector 60 generates an output signal. This will normally cause the apparatus to dispense water through discharge conduit 24 to the protected location within a few seconds after the detector 60 senses an abnormal condition. A manual reset switch associated with a time delay (not shown) may be provided so that the dispensing of water may be delayed for a predetermined length of time if desired. Such feature may be useful for example, if sprinkler head 28 is directly over a bed occupied by an aged or infirm patient; this allows time to move the patient before the area is inundated when an observer sees that this may be safely done. The valve actuator system may also include a normally open on/off switch (typically a button switch) which will permit manual actuation of valve 50. Such a switch is useful so that an observer on the scene can cause the apparatus to function in the event an emergency occurs while detector 60 is malfunctioning. Other modifications of the valve actuation system will be apparent to those skilled in the art.

The preferred quick release valve 50 will now be described in further detail with reference to FIGS. 3, 4 and 5. The preferred valve 50 is a one-shot valve. FIGS. 3 and 4 show this valve prior to actuation.

Referring now to FIGS. 3 and 4, valve 50 comprises a pair of members, here shown as rectangular blocks or plates 70, 72, preferably of a metal such as stainless steel, copper, or brass, which are joined together by a thin layer 74 of solder, brazing material, or other bonding material which would join the blocks 70 and 72 together by a fusion seal. The illustration in FIGS. 3 and 4 is larger than actual size; typically the thickness of valve 50 (the combined thickness of blocks 70 and 72 and bonding material 74) is on the order of about ¾ inch (approximately 1.9 cm). The bonding layer 74 is generally very thin, typically about 0.001 inch (about 0.025 mm). Blocks 70 and 72 have mating surfaces, preferably planar; the layer 74 of material which bonds these two blocks together is applied to these surfaces. One of the blocks, here shown as block 70, has a port 76 extending in the thickness direction from the outside surface to the central surface to which bonding material 74 is applied. This port 76 may be provided with a shoulder 78, which provides a limit stop for the end of tube 46.

Valve 50 is provided with a bore 80, which lies half in block 70 and half in block 72. The axis of bore 80 preferably lies in the plane of the bonding material 74 (i.e., the interfacial plane between blocks 70 and 72) and is at right angles to the outer edge surfaces of valve 50. Bore 80 permits the insertion of a radially expandable actuator (hereinafter called a radial actuator) 82, which will break the bonding layer 74 and cause blocks 70 and 72 to fall away from each other when actuated.

The bonding layer 74 should have a tensile strength lower than that of the material forming blocks 70 and 72. On the other hand, the tensile strength of the adhesive material must be enough to hold blocks 70 and 72 together until actuator 82 is actuated, and to withstand the pressure differential between the propellant pressure (communicated through port 76) and the much lower pressure surrounding the valve 50. Conventional tin/lead solders or metallic brazing materials meet these tensile strength requirements in addition to providing the required adhesion. By using a bonding material which is less strong than the material of blocks 70 and 72, these blocks remain intact after actuation.

Actuator 82 is a state-of-the-art actuator comprising a metal casing 84 which has a main body portion 86 of one diameter and a forward portion 88 of smaller diameter. The diameter of the forward portion 88 is just enough smaller than the diameter of bore 80 to provide enough clearance for ready insertion of the actuator 82. The diameter of the main body portion 86 is larger than that of bore 80. The casing 84 is closed at the forward end and open at the back end. The back end is closed by a squib 90 which comprises a metal sleeve 91, a glass insulator 92 which forms a fluid-tight glass-to-metal seal with the sleeve 91, a pair of spaced lead wires or pins 93, 94, which extend through the insulator 92, a bridge element (e.g., a bridge wire) 96 connecting the ends of lead wires 93, 94, and an ignition composition (not shown) in proximity with the bridge element 96. The back end of casing 84 is crimped over sleeve 91, forming a fluid-tight seal. Inside the metal casing 84, in the forward portion 88 thereof, is an explosive charge 98, typically lead azide. The casing 84, and particularly the expandable forward portion 88 thereof, should be made of a material such as a relatively ductile stainless steel which can deform radially without rupturing or leaking.

Figure 6:
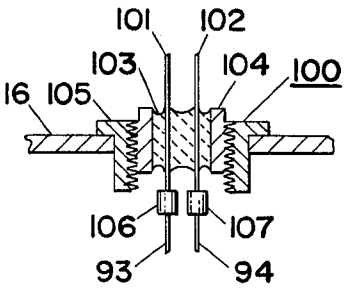
FIG. 6 is a cross-sectional view of an insulator plug assembly which provides for electrical connections between the interior and the exterior of the liquid storage container of the present invention.

Referring now to FIG. 6, insulator plug assembly 100 in the top 16 of container 10 permits the transmission of electrical signals from detector 60 (FIGS. 1 and 2) to actuator 82 (FIGS. 3 and 4), which actuates valve 50. Assembly 100 has a pair of spaced conductive pins 101, 102 which pass through glass insulator 103. Insulator 103 is bonded to externally screw threaded metal sleeve 104 by a gas-tight glass-to-metal seal. Externally screw threaded sleeve 104 is received by internally screw threaded collar 105, which is joined by a gas-tight seal (e.g., by welding) to top 16. Pins 101, 102 are electrically connected to pins 93, 94 respectively of actuator 82 by receptacles 106, 107 respectively. Connections not shown electrically connect pins 101, 102 with external wires 64, 66 respectively.

Valve 50 is actuated by applying an electric current through leads 93, 94 to bridge wire 96 and the associated ignition composition. Ignition of this composition causes the explosive composition 98 to explode, which in turn causes localized radial expansion of the forward portion 88 of the casing 84. The expanded diameter of this portion 88 is only slightly larger (say about 0.010 to about 0.015 inch greater) than the normal diameter of this same portion. However, this radial expansion is enough to force blocks 70 and 72 apart, overcoming the tensile strength and elongation of the solder or brazing material layer 74. Radial expansion of the expandable forward portion 88 of casing 84 places the layer 74 under a severe tensile stress, sufficient to cause an elongation of about 1000 to 1500% in the solder or brazing material. (The percentage elongation is obtained by dividing the difference between the expanded diameter and the normal diameter of portion 88 by the original thickness of layer 74, and multiplying the quotient by 100). This is a greater elongation than the material 74 can withstand.

Operation of the First Embodiment

The apparatus shown in FIGS. 1–6 is set up so that the sprinklerhead 28 is above the area or space to be protected, the detector 60 is in or near the protected area, and the first container 10 is in some suitable nearby location. For example, suppose that the apparatus is used to protect the area surrounding the bed of an elderly or infirm patient, and is used to put out any fire that might break out due to smoking in bed. The sprinklerhead will be placed over the bed, the detector 60 will be located nearby, and the container 10 could be placed in some nearby location, say a closet, a stairway landing, or the corner of the patient's room.

FIGS. 1–4 show the apparatus of the invention in its state prior to actuation, i.e., in the "normal", "ready", or "standing" state. In this state the body of water 20 and the headspace thereabove are under ambient conditions, typically a temperature of about 20°–25° C. (about 68°–77° F.) in both the body of water and the headspace, and atmospheric pressure in the headspace. The liquid propellant inside tubular container 40 is under much higher pressure, i.e., the vapor pressure of the propellant, which will depend on the volatility of the material selected. The preferred propellant, dichlorodifluoromethane, has a boiling point of −28° C. at atmospheric pressure and a vapor pressure of about 75 psig at 20° C. It is commercially available as a refrigerant. The quantity of propellant is enough to empty out the container 10, down to a level just above that of inlet 26 of discharge conduit 24. In other words, the gas volume of the propellant as saturated vapor at ambient temperature is slightly greater than the volume of container 10.

The apparatus will stand in its ready state as long as detector 60 does not sense any abnormal state. Now suppose that a fire breaks out in the vicinity of detector 60. Detector 60, whether a smoke detector, a flame detector, a rate-of-rise temperature detector, or a high temperature detector, detects this fire and generates an output signal. This output signal causes valve 50 to be actuated. This in turn opens up the normally closed passageway 46, permitting the propellant to vaporize and flow into the headspace of container 10. This pressurizes the interior of container 10, forcing the liquid level downwardly and thereby forcing liquid out through the discharge conduit 24. The liquid flows out into the annular space between container side wall 12 and baffle side wall 36, in heat exchange relationship with the propellant inside the tubular container 40. The coiled section of tube 40 provides a large heat exchange surface, permitting rapid heat transfer. The heat of vaporization required by the propellant is furnished by the flowing stream of water as it flows downwardly through container 10 and then out through discharge conduit 24. Heat is transferred rapidly so that substantially the entire quantity of propellant is evaporated with a temperature drop of only a few degrees C. Since the temperature of the propellant remains virtually unchanged as it vaporizes and flows into the headspace of vessel 10, the pressure also remains virtually unchanged. Thus, the operating (or headspace) pressure during dispensing is virtually equal to the vapor pressure of the propellant, which is also the actual pressure of the propellant when the apparatus is in the standing state.

Description of the Second Embodiment

Figure 7:
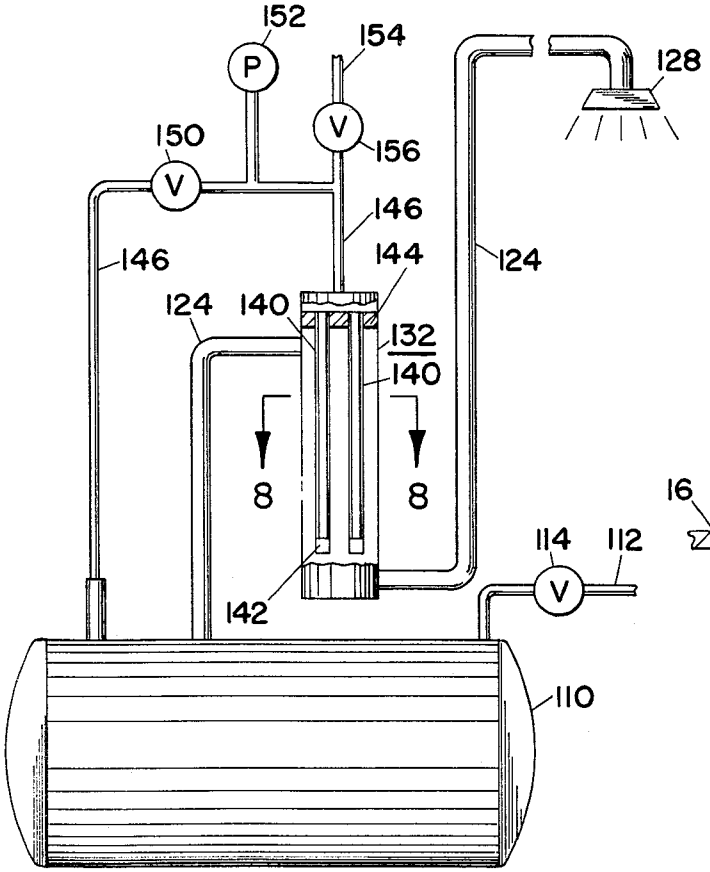
FIG. 7 is a front elevational view, shown partly in section, of an apparatus according to a second embodiment of this invention.

The second embodiment of this invention will now be described with reference to FIGS. 7, 8, and 9. This embodiment, like the first embodiment, describes an apparatus for protecting an area against the outbreak of fire. The area to be protected may be a comparatively small, high risk area, such as a bed where smoking may occur, and the area immediately surrounding the bed. On the other hand, tank 110 in this embodiment may be larger than is practical in the first embodiment, so that a larger area may be protected. This embodiment may be used to protect multiple separate locations, such as several rooms in a building, or even a whole building. Referring now to FIG. 7, first container or tank 110, shown here as a horizontal cylindrical vessel, contains water or other fire extinguishing liquid. The container is filled until water occupies most of the vessel, leaving a small headspace for air at the top. Container 110 is fluid tight and capable of withstanding pressure.

Container 110 may optionally be provided with a refill line 112 having a manually controlled valve 114. This line permits refilling of vessel 110 after use.

The apparatus includes a discharge conduit 124, which extends from the interior of vessel 110 to a sprinkler head 128 above the area to be protected against fire. As in the apparatus of FIG. 1, the discharge conduit 124 has an inlet opening (not shown) below the normal liquid level in vessel 110 and preferably near the bottom thereof. Also as in the apparatus of FIG. 1, the sprinkler head 128 and a portion of the discharge conduit 124 are above the normal liquid level in vessel 110, so that liquid will be discharged from vessel 110 only when the vessel is pressurized.

Figure 8:
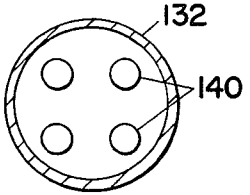
FIG. 8 is a cross-sectional view of a heat exchanger, taken along 8—8 of FIG. 7.

Liquid flowing through discharge conduit 124 passes through heat exchanger 132, which is shown in FIGS. 7 and 8. Heat exchanger 132 includes a second container 140 in the form of a plurality of vertical tubes (four are shown), which are closed at the lower ends 142 and open at their upper ends, and which are suspended from tube sheet 144 near the top of the heat exchanger. These tubes serve as a container for a volatile propellant liquid under pressure. As in the first embodiment, the preferred propellant is dichlorodifluoromethane. Liquid flowing through the discharge conduit 124 passes through the shell side of heat exchanger 132.

A transfer line 146 for propellant vapors under pressure extends from the top of heat exchanger 132 to the top of vessel 110. A sight glass (not shown) may be placed in transfer line 146 just above heat exchanger 132 for visual observation of the propellant level. A normally closed valve 150 maintains the transfer line 146 in the normally closed state. Details of a preferred valve 150 will be described hereinafter with reference to FIG. 9. Also associated with transfer line 146 are a pressure gauge 152, and a refill pipe 154, having manually controlled normally closed valve 156 therein, for refilling the tubes 140 with propellant after use.

Referring now to FIG. 9, valve 150 has a hollow cylindrical casing 170 which encloses a cylindrical chamber. Ports 172 and 174, which are axially offset, extend from the exterior to the interior of casing 170. Either port 172 or port 174 may serve as the inlet, and the other serves as the outlet. These ports are connected to the inlet and outlet sides of transfer line 146.

One end of casing 170 is closed by a metal plate 176, which is bolted to the casing. The other end of casing 170 is closed by squib 178.

A spool 180, which is actuated by squib 178, slides inside casing 170. The diameter of spool 180 is just slightly smaller than the internal diameter of casing 170, so as to permit the spool to slide on command. Spool 180 has a reduced diameter portion 182 of axial length slightly greater than the axial distance between ports 172 and 174, so that the reduced diameter portion 182 will completely span ports 172 and 174 when spool 180 is in the valve open position. This reduced diameter portion provides a space for propellant vapors, and permits communication between ports 172 and 174 when the valve is in its open position. The valve as shown is in its closed position. Spool 180 is provided with sealing rings, preferably O-rings 184, 186, and 188.

Squib 178 is of conventional structure, comprising conductive pins 190, 192, bridge wire 194, and an ignition composition 196 surrounding the bridge wire. Conventional ignition compositions may be used; lead styphnate is a preferred ignition composition. A base charge (not shown), preferably lead mononitroresorcinol, is placed next to the ignition charge. The leads 190, 192 extend through glass plug 198, which forms a glass-to-metal seal with a surrounding sleeve 200. Preferably this sleeve 200 has portions of different external diameters, as shown, the smaller diameter portion being externally screw threaded and received in an internally screw threaded socket at one end of casing 170. Casing 170 preferably has a shoulder as shown at the squib end to limit the travel of spool 180. A closure disc 202 may be placed across the opening in front of the ignition charge if desired. This disc is received in a recess in sleeve 200.

The spool valve 150 is generally similar to that shown in my U.S. Pat. No. 3,713,458, except that the match composition of the patent has been replaced by a squib, and the location of the reduced diameter portion (182 herein) of the spool has been changed so as to provide a normally closed valve, instead of the normally open valve of the patent.

The valve actuation system described with reference to the first embodiment and particularly FIGS. 1 and 2 may be used to actuate valve 150.

Operation of the Second Embodiment

The apparatus of the second embodiment is operated in a manner generally similar to that of the first embodiment. The apparatus as shown in FIGS. 7, 8 and 9 is in the "ready" state, i.e., the state prior to actuation. In this state, vessel 110 is filled with water to level shortly below the top thereof, leaving a headspace which is occupied by air at atmospheric pressure. Discharge conduit 128 and the shell side of heat exchanger 132 are filled with air under ambient conditions while the apparatus is standing in the "ready" state.

The apparatus may be actuated in the same manner as the apparatus of the first embodiment. That is, actuation is normally initiated when a detector such as that shown as detector 60 in FIG. 2 senses an abnormal condition, e.g., fire, smoke, or an abnormally high temperature, in the protected area. This causes the ignition composition 196 in spool valve 150 (FIG. 9) to ignite, moving spool 180 to the open position. This allows propellant vapors to flow into the headspace of container 110. More propellant vaporizes and propellant flow into vessel 110 continues, building up the pressure in the headspace to desired operating level, e.g., approximately 75 psig (approximately 6 atmospheres absolute). This pressure causes water to be discharged through discharge conduit 124 and sprinklerhead 128. As water flows through the heat exchanger 132, heat is transferred from the water to the propellant, providing the heat of vaporization necessary for continued evaporation of propellant. The propellant temperature drops by only a few degrees. Discharge of water continues under constant pressure in the headspace of vessel 110 until the water drops to a level just above the inlet of discharge conduit 124. Then the float valve (not shown) controlling the inlet of conduit 124 closes, preventing further discharge of water and also preventing propellant vapors from escaping into the atmosphere. In this manner virtually the entire water content of vessel 110 is emptied, and propellant temperature and pressure drop is prevented by heat transfer from water to propellant, which continues as long as water is being discharged from the apparatus.

After the apparatus has functioned, it can be made ready for reuse by refilling vessel 110 with water, refilling tubes 140 with propellant in liquid form, providing valve 150 with a new squib 178, and resetting the position of spool 180 in valve 150. Water and propellant are refilled through inlet pipe 112 and branch pipe 154, respectively.

EXAMPLE

A prototype apparatus according to the second embodiment of this invention (FIGS. 7–9) was built with the following dimensions:

| | |
|---|---|
| Tank (container 10) size | 20 gallons (75.7 liters) |
| Tubes 140 (4 tubes): | |
| Outside diameter (O.D.) | 0.875 inch (2.22 cm) |
| Inside diameter (I.D.) | 0.790 inch (2.01 cm) |
| Volume (total) | 129 $in^3$ (2114 $cm^3$) |
| Heat transfer area (mean*) | 690 $in^2$ (4455 $cm^2$) |
| Length (each tube) | 66 inch (168 cm) |

*Calculated from mean tube diameter.

The heat transfer tubes were made of hardwall copper tubing. The ratio of heat transfer surface area to tube volume was 5.35 $in^{-1}$ (690 divided by 129) or 2.11 $cm^{-1}$. The tubes were filled with 6.18 lb (2.80 kg) of dichlorodifluoromethane.

When valve 150 was actuated, the entire quantity of water in tank 110 was dispensed. Most of the dichlorodifluoromethane (propellant) was vaporized and passed into the headspace of tank 110. Only a slight drop in propellant temperature and pressure occurred during dispensing.

Modifications

Various modifications can be made without departing from the spirit of this invention, as will be apparent to those skilled in the art. For example, the container for propellant may be either inside or outside the container for liquid to be dispensed, as shown in the two illustrative embodiments which have been described. Other examples will be described below.

The discharge conduit shown (24 in FIGS. 1 and 2, 124 in FIG. 7) may be replaced by a normally closed opening near the bottom of the first container (10 in FIGS. 1 and 2, 110 in FIG. 7). This arrangement may be used when the container is located inside the protected area. This arrangement requires some means, such as a valve, which will maintain the opening normally closed and which may be opened on command when the first container is pressurized.

The valve (50 or 150) which initiates functioning of the apparatus may be either inside the container for liquid to be dispensed as in FIGS. 1 and 2, or outside this container as in FIG. 7. This valve may take various forms. For instance, a solenoid operated valve may be used instead of either of the two explosively actuated valves shown, although the seals of a solenoid valve (and of most valves) will tend to leak after standing for a long period of time. Such valve is therefore not preferred. Also, a manually actuated valve can be used, particularly if the valve is outside the storage vessel for liquid to be dispensed. Use of a manually operated control valve may be acceptable where the protected area is under constant or very frequent surveillance by an individual who is capable of taking immediate action in an emergency, although of course the preferred automatic actuation system described gives far greater protection. In fact, it is not necessary to use a control valve at all, as long as some means are provided for keeping the propellant transfer line closed until it is necessary to use the apparatus. For example, valve 50 in the first embodiment (FIGS. 1 and 2) may be replaced by an explosively actuated piston actuator and a metal cutter associated therewith, mounted so that the cutter on actuation moves forward at right angles to the direction of the transfer line 46. In this case the discharge end of transfer line 46 is closed, and the side wall of line 46 is notched a short distance from the discharge end to facilitate cutting.

The system of the second embodiment (FIGS. 7–9) may have a plurality of sprinkler heads 128 (which may be located in different rooms) and a separate sensor 60 near each sprinkler head. It is important in this arrangement to discharge water only through the sprinkler head which is at the location of the fire. To that end, each of the conduits 124 leading to a sprinkler head should have a normally closed valve which opens when the sensor associated with that conduit and sprinkler head generates an output signal.

Various other modifications, some of which have been suggested earlier, may also be made without departing from this invention.

The apparatus of this invention may be used for purposes other than fire protection. For example, the present apparatus may be used as an emergency shower at a construction site. Opening valve 50 will ordinarily be initiated manually in this service. The apparatus may also be used as a fire extinguisher at a temporary storage site for high value materials. It is frequently desirable to use bromochlorodifluoromethane (BCF) instead of water in this service. The apparatus may also be used as a standby emergency water supply.

Advantages

The apparatus of this invention possesses various advantages not possessed by previously known fire protection apparatus.

As compared to conventional automatic sprinkler systems, the present apparatus offers a much less costly alternative for protection of a limited high risk area, and is much more easily installed in existing buildings.

The apparatus of the present invention also offers advantages over previously known self-contained sprinkler systems, such as those illustrated in the pages of the Fire Protection Handbook cited earlier. A major advantage is that much lower operating pressures are encountered in the apparatus of the present invention. Maximum operating pressures in the present apparatus are usually no higher than 125 psig, while pressures of about 75 psig are typical. This contrasts with pressures as high as 2,000 psig in nitrogen storage cylinders of the presently known self-contained apparatus. Lower pressures result in greater safety. Also, the apparatus of the present invention does not require pressure regulators, the seals of which may leak in time. Instead, the preferred form of present apparatus employs a propellant container system having hermetic seals, such as fusion seals which can stand indefinitely without leakage.

The present apparatus offers a major advantage over other dispensing apparatus which employs a propellant under pressure to cause discharge of a liquid on command. That is, the present apparatus provides efficient heat transfer from water (or other fluid being dispensed) to the vaporizable propellant while discharge is taking place. This is accomplished by using a thin container, with high heat transfer surface area and high surface to volume ratio, for the propellant. Efficient heat transfer is sustained throughout the discharge operation, so that constant discharge pressure can be maintained. By contrast, apparatus such as that shown in Bayne U.S. Pat. No. 3,613,954 cited above has a much smaller surface to volume ratio for the propellant container, and in addition maintains the fluid to be dispensed under subatmospheric temperatures, which further impedes heat transfer. The conventional aerosol cans are intended only for small volumes and for intermittent dispensing, and do not lend themselves to being scaled up to the size necessary for the objectives of the present invention.

Another advantage is that the propellant level can be observed visually. It is not necessary to weigh the apparatus in order to determine whether or not it is ready for operation.

What is claimed is:

1. Apparatus for dispensing a liquid in an emergency, said apparatus comprising:

(a) a container which is normally under substantially atmospheric pressure for containing a first liquid to be dispensed, said container having an outlet for discharging said liquid from said container when said container is pressurized;

(b) one or more tubes for containing a volatile propellant in liquid form under pressure, each of said tubes being open at one end and closed at the other end, said tube(s) having a high ratio of wall surface to volume so as to provide a substantial wall surface area for heat transfer;

(c) means providing for heat transfer via indirect heat exchange from a flowing stream of said first liquid to said propellant during dispensing of said first liquid;

(d) a normally closed passageway connecting the open end(s) of said tube(s) with the interior space of said container; and (e) means operable from outside said container and responsive to an abnormal condition at a protected location for opening said passageway to permit propellant vapors to flow from said tube(s) to said container, thereby pressurizing said container and causing said first liquid to be dispensed.

2. Apparatus for dispensing a liquid in an emergency, said apparatus comprising:

(a) a container which is normally under substantially atmospheric pressure for containing a first liquid to be dispensed, said container having an outlet for discharging said liquid from said container when said container is pressurized;

(b) one or more tubes for containing a volatile propellant in liquid form under pressure, each of said tubes being open at one end and closed at the other end, said tube(s) having a high ratio of wall surface to volume so as to provide a substantial wall surface area for heat transfer;

(c) means providing for heat transfer via indirect heat exchange from a flowing stream of said first liquid to said propellant during dispensing of said first liquid;

(d) a normally closed passageway connecting the open end(s) of said tube(s) with the interior space of said container;

(e) a normally closed explosively actuated one shot valve for maintaining said passageway normally closed; and (f) means operable from outside said container for opening said passageway to permit propellant vapors to flow from said tube(s) to said container, thereby pressurizing said container and causing said first liquid to be dispensed.

* * * * *